US005452858A

United States Patent [19]

Tsuzuki et al.

[11] Patent Number: 5,452,858

[45] Date of Patent: Sep. 26, 1995

[54] FUEL INJECTOR FOR INTERNAL COMBUSTION ENGINE HAVING THROTTLE PORTION

[75] Inventors: Yoshihiro Tsuzuki, Handa; Toshihiko Igashira, Toyokawa; Yasuyuki Sakakibara, Nishio; Kazuhide Watanabe, Toyohashi; Takehiko Kato, Nishio; Terutoshi Tomoda, Susono, all of Japan

[73] Assignees: Nippon Soken Inc., Nishio; Toyota Jidosha Kabushiki Kaisha, Toyota, both of Japan

[21] Appl. No.: 209,104

[22] Filed: Mar. 11, 1994

[30] Foreign Application Priority Data

Mar. 24, 1993 [JP] Japan ..... 5-089317

[51] Int. Cl.[6] ..... F02M 51/06

[52] U.S. Cl. ..... 239/533.8; 239/584

[58] Field of Search ..... 239/95, 96, 102.2, 239/533.8, 584; 251/52, 129.06

[56] References Cited

U.S. PATENT DOCUMENTS

| | | | |
|---|---|---|---|
| 4,006,859 | 2/1977 | Thoma | 239/533.8 X |
| 4,535,743 | 8/1985 | Igashira et al. | 239/584 X |
| 4,579,283 | 4/1986 | Igashira et al. | 239/102.2 X |
| 4,646,976 | 3/1987 | Rembold et al. | 251/52 X |
| 4,725,002 | 2/1988 | Trachte | 239/102.2 |
| 4,728,074 | 3/1988 | Igashira et al. | 239/584 X |
| 4,909,440 | 3/1990 | Mitsuyasu et al. | 239/533.8 X |
| 5,219,122 | 6/1993 | Iwanaga | 239/533.8 |
| 5,323,964 | 6/1994 | Doszpoly et al. | 239/533.8 X |

FOREIGN PATENT DOCUMENTS

| | | |
|---|---|---|
| 59-206668 | 11/1984 | Japan . |
| 4-11256 | 1/1992 | Japan . |

*Primary Examiner*—Willam Grant

*Attorney, Agent, or Firm*—Cushman, Darby & Cushman

[57] ABSTRACT

A fuel injector wherein a piston driven by the extension and contraction of a piezoelectric actuator changes the pressure of a working fluid in a variable pressure chamber and back pressure chamber so as to drive a needle valve to open and close a fuel injection hole, wherein undesirable secondary injection after a main injection in prevented by providing a throttle portion for narrowing the communicating passage between the variable pressure chamber and back pressure chamber when the piston moves forward and the needle valve closes the fuel injection hole.

6 Claims, 7 Drawing Sheets

FUEL INJECTOR FOR INTERNAL COMBUSTION ENGINE HAVING THROTTLE PORTION

BACKGROUND OF THE INVENTION

1. Field of the Invention

The present invention relates to a fuel injector for internal combustion engines, more particularly relates to a fuel injector which effectively prevents the occurrence of the undesirable phenomenon of secondary injection after the main injection.

2. Description of the Related Art

In a known fuel injector as disclosed for example in Japanese Unexamined Patent Publication (Kokai) No. 59-206668, when a high voltage is applied to a piezoelectric actuator to stop a fuel injection, the activation is made to extend, a back pressure chamber is made high in pressure, a needle valve is pushed down, the volume of the back pressure chamber enlarges by exactly the amount of lift of the needle valve, and the pressure drops. The pressure pulsation caused at this time is transmitted from a communicating passage to a variable pressure chamber and acts on a piston member to cause the actuator to vibrate and expand and contract. As a result, the pressure pulsation is amplified, and the needle valve opens for a short time once again, causing secondary injection. In extreme cases, several secondary injections occur.

SUMMARY OF THE INVENTION

The present invention was made in order to solve these problems and has as its object the provision of a fuel injector which can prevent the occurrence of secondary injection by a simple construction and can vastly improve the fuel injection characteristic.

According to the present invention, there is provided a fuel injector comprising a piezoelectric actuator which extends and contracts by conduction, a piston member which moves back and forth along with the piezoelectric actuator, a variable pressure chamber which is filled with a working fluid and which is made to rise in pressure when the piston member moves forward, a back pressure chamber which communicates with the variable pressure chamber and in which a working fluid is sealed, and a needle valve which opens and closes a fuel injector hole in accordance with a pressure of the back pressure chamber, the back pressure chamber being provided with a throttle portion for throttling the flow of working fluid between the variable pressure chamber and the back pressure chamber and also a bypass passage being provided for enabling the fluid to flow from the back pressure chamber to the variable pressure chamber when the piston member retracts.

BRIEF DESCRIPTION OF THE DRAWINGS

Other objects and effects of the invention will become more apparent from the following detailed description made with reference to the attached drawings, in which.

DESCRIPTION OF THE PREFERRED EMBODIMENTS

Before describing the preferred embodiments of the present invention, a more detailed description will be given of the related art for reference sake.

Figure 1:
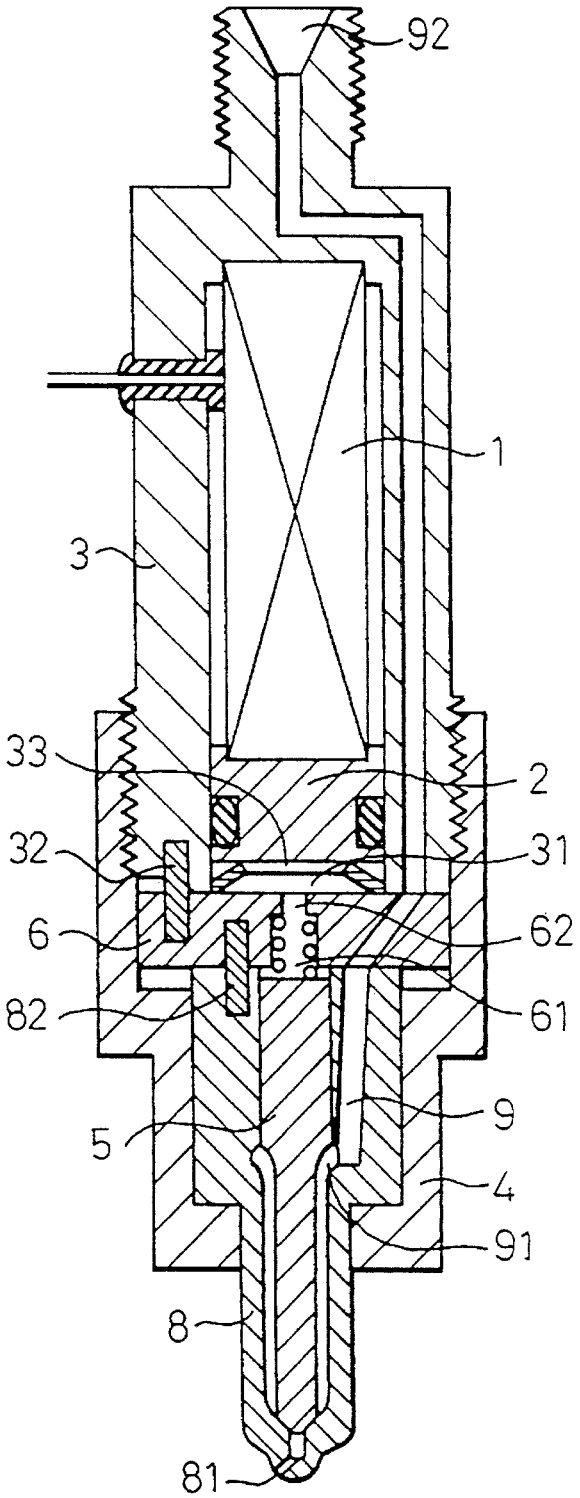
Fig.1 PRIOR ART
FIG. 1 is an overall sectional view of a conventional fuel injector.

FIG. 1 shows an example of the conventional fuel injector. In the figure, there is shown a cylindrical retaining nut 4 with step-wise differences in diameter inside of which is provided a nozzle body 8 having a portion projecting downward through an opening in the front end face of the nut. At the front end of the nozzle body 8 is formed an injector hole 81 for injecting the fuel.

In the nozzle body 8 is provided a needle valve 5 able to move freely up and down. The bottom end of the same contacts a seat at the inner circumference of the front end of the nozzle body 8 to close the injector hole 81. The lower half of the needle valve is smaller in diameter. One end of a fuel passage 9 reaches the outer circumference of the valve through an oil reservoir 91 formed around the boundary with the upper half of the valve.

The other end of the fuel passage 9 extends upward in the circumferential wall of a cylindrical casing 3 with a closed top end, which casing is positioned by a knock pin 82 screwed into an opening of the retaining nut 4 through a distance piece 6 positioned by a knock pin 82 and in contact with the top end of the nozzle body 8, and reaches a fuel inlet 92 open in the top wall.

The top end of the needle valve 5 is close to a small diameter back pressure chamber 61 formed at the center of the distance piece 6 and is biased downward by a coil spring inserted in the back pressure chamber 61. Inside the casing 3 is accommodated a known piezoelectric actuator 1, comprised of a stack of a plurality of disk shaped ceramic piezoelectric elements, with its top end affixed to the casing wall. At the bottom end is provided, in contact with the same, a piston member 2 which can move up and down along the inner circumferential wall of the casing 3.

Below the piston member 2 is formed a large diameter variable pressure chamber 31, which variable pressure chamber 31 communicates with the back pressure chamber 61 by a communicating passage 62. Note that the above-mentioned piston member 2 is biased upward by a plate spring 33 inserted inside the variable pressure chamber 31.

The state illustrated is one where a voltage of about 500 V is applied to cause the piezoelectric actuator 1 to extend. If the conduction state is switched and some negative voltage is applied from this state, the actuator 1 contracts and returns to its original length. Along with this, the piston member 2 rises. Also, along with the fall in the internal pressure of the variable pressure chamber 31 and the back pressure chamber 61, the needle valve 5 is pushed up and the injector hole 81 opens to inject fuel.

A fuel injector of this construction is disclosed for example in Japanese Unexamined Patent Publication (Kokai) No. 59-206668.

In this conventional construction of a fuel injector, when a high voltage is applied to the piezoelectric actuator 1 once again to stop the fuel injection, this is made to extend, the back pressure chamber 61 is made high in pressure, the needle valve 5 is pushed down, the volume of the back pressure chamber 61 enlarges by exactly the amount of lift of the needle valve 5, and the pressure drops. The pressure pulsation caused at this time is transmitted from the communicating passage 62 to the variable pressure chamber 31 and acts on the piston member 2 to cause the actuator 1 to vibrate and expand and contract. As a result, the pressure pulsation is amplified, and the needle valve 5 opens for a short time once again. In extreme cases, several secondary injections occur.

Figure 2:
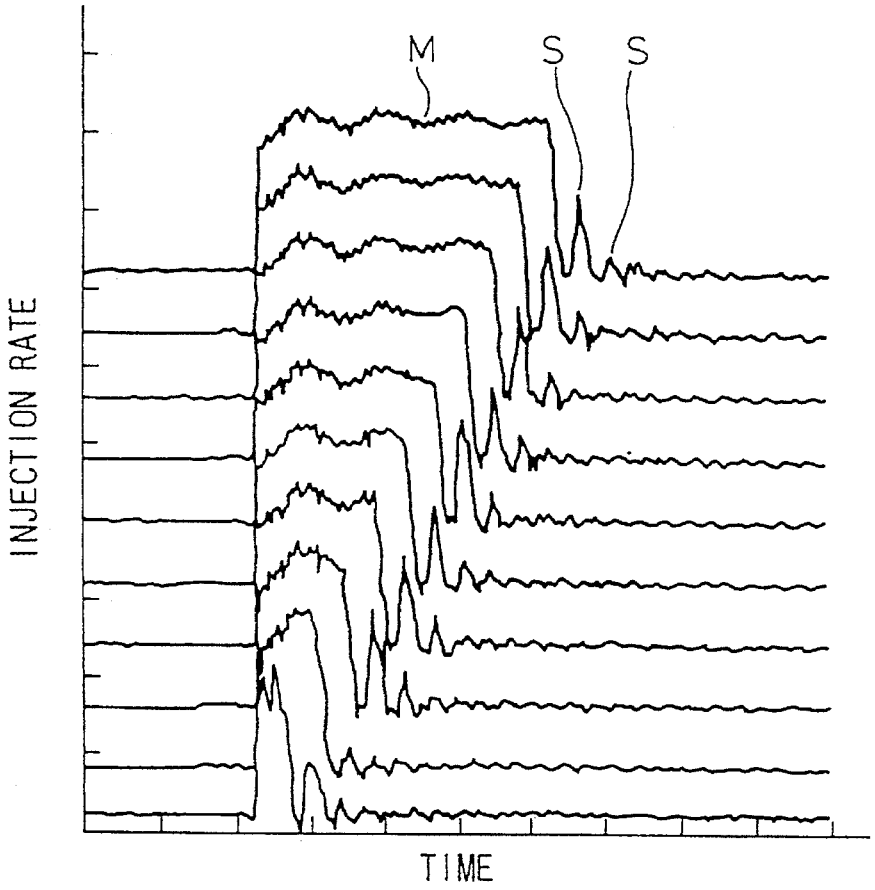
Fig. 2 PRIOR ART
FIG. 2 is a time chart of the injection rate of a conventional fuel injector.
Figure 3:
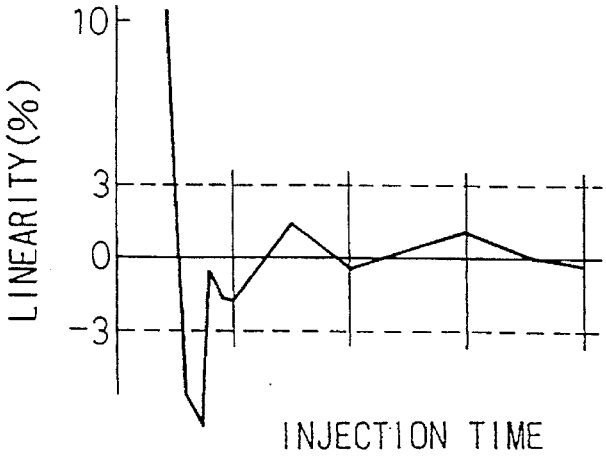
Fig. 3 PRIOR ART
FIG. 3 is a graph of the relationship between the injection time and linearity of the injection amount for a conventional fuel injector.

This state is shown in FIG. 2. As will be understood from this figure, even if the injection time is changed, a short period of secondary injection S always occurs right after the main injection M and causes a deterioration of the adjustment accuracy and exhaust emission. Further, the conduction time of the piezoelectric actuator and the linearity of the amount of fuel injection also deteriorate tremendously in the small volume injection region due to the presence of the secondary injection, as shown in FIG. 3.

Figure 4:
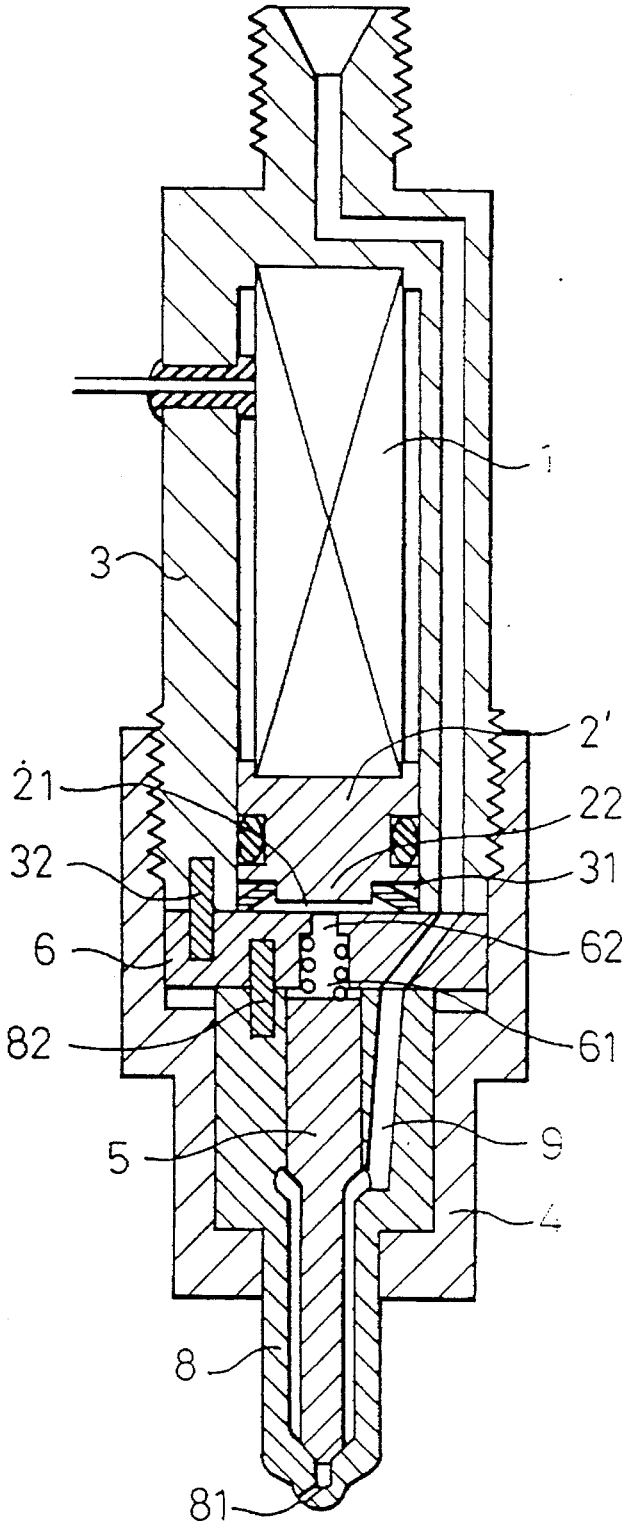
FIG. 4 is an overall sectional view of a fuel injector in a first embodiment of the present invention.
Figure 8A:
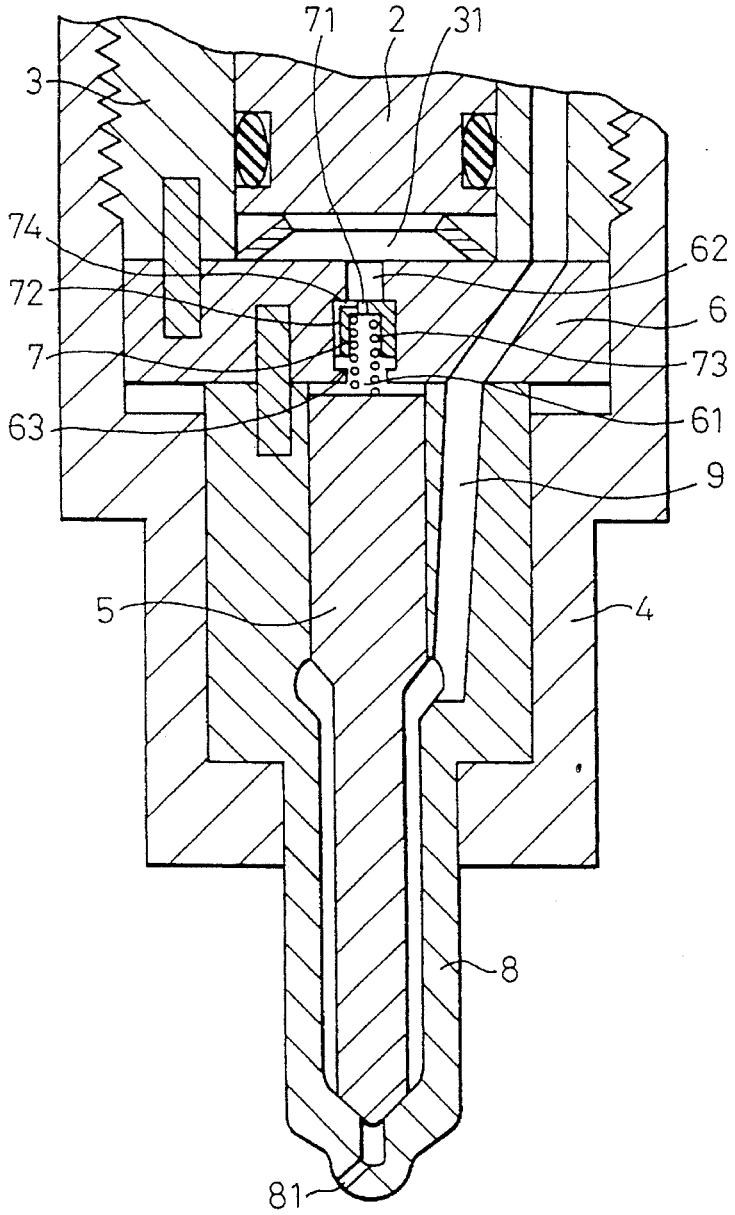
FIG. 8A is a partial enlarged sectional view of a fuel injector in a second embodiment of the present invention.

Explaining next the features of the fuel injector of the present invention with reference to the drawings showing embodiments, provision is made of a fuel injector provided with a piezoelectric actuator 1 which expands and contracts by conduction, a piston member 2' which moves back and forth integrally with the same, a variable pressure chamber 31 which is filled with a working fluid and which is made to rise in pressure when the piston member 2' advances, a back pressure chamber 61 which communicates with the variable pressure chamber 31 and has a diameter smaller than the same, and a needle valve 5 which has a base end near the back pressure chamber 61 and moves forward in accordance with a pressure rise of the back pressure chamber 61 to close the fuel injector hole 81, wherein the communicating passage 62 connecting the variable pressure chamber 31 and the back pressure chamber 61 is provided with a throttle portion which operates when the piston member 2' moves forward and reduces the sectional area of the throttle passage 21. When the throttle portion is formed as a projection 22 of the piston member 2 as shown in FIG. 4, the clearance serving as the throttle passage 21 is made not more than 0.1 mm. When the throttle portion is formed by a throttle valve 7 as shown in FIG. 8A, the throttle valve 7 is made slidable in the back pressure chamber 61 and the throttle valve 7 serving as the throttle portion is provided with bypass passages 72, 74 opened and closed by the position of the throttle valve 7.

In this fuel injector, when the main injection is ended, the piston member 2' is made to move forward by the piezoelectric actuator 1. Along with this, the internal pressure of the variable pressure chamber 31 rises. The internal pressure of the back pressure chamber 61 communicated with this also rises, so the needle valve 5 moves forward and the fuel injector hole 81 is closed. In the process, a pressure pulsation is caused in the back pressure chamber 61.

In this case, the throttle portion 22 operates when the piston member 2' moves forward and so the area of the inlet passage of the communicating passage 62 is reduced. The flow resistance increases, so the transmission of the pressure pulsation from the back pressure chamber 61 to the variable pressure chamber 31 is effectively suppressed. The pulsation is not amplified by the piston member 2', so the needle valve 5 is not made to retract. Accordingly, the problem of the needle valve 5 opening once again and secondary injection being caused when the main injection ends is prevented.

When starting the main injection, the piston member 2' is made to retract. At that time, the throttle portion 22 does not operate, so the fall in internal pressure of the variable pressure chamber 31 is transmitted through the throttle passage 21 quickly to the back pressure chamber 61, the needle valve 5 quickly retracts, and the fuel injection is started.

As explained above, according to the fuel injector according to the present invention, it is possible to effectively prevent secondary injection by a simple structure and it is possible to vastly improve the injection characteristic such as to improve the adjustment accuracy and improve the linearity of the amount of injection.

Giving now a more specific explanation, FIG. 4 shows a fuel injector of a first embodiment of the present invention. The basic structure is the same as the conventional one already explained. Accordingly, the points of difference will be basically explained below.

In the figure, the piston member 2' contacting the bottom end of the piezoelectric actuator 1 has a center portion at the bottom surface near the variable pressure chamber 31 which projects outward. In the illustrated state with the piston member 2' moved forward, the projecting throttle portion 22 comes into close proximity to the top surface of the distance piece 6 and forms a throttle passage 21 with a small clearance. Further, the variable pressure chamber 31 is formed substantially between the outer circumference of the bottom surface of the piston member 2' and the distance piece 6.

The needle valve 5 is made to move forward (descend) by the rise in pressure of the back pressure chamber 61 and closes the fuel injector hole 81, but during this time a pressure pulsation occurs in the back pressure chamber 61. Here, the communicating passage 62 communicating the back pressure chamber 61 and the variable pressure chamber 31 substantially shrinks in sectional area along with the forward movement of the piston member 2' due to the throttle passage 21 formed there and the flow resistance increases, so the transmission of the pressure pulsation from the back pressure chamber 61 to the variable pressure chamber 31 is effectively suppressed and the pulsation will not be amplified by the piston member 2'. Due to this, the retraction of the needle valve 5 is inhibited.

Figure 5A:
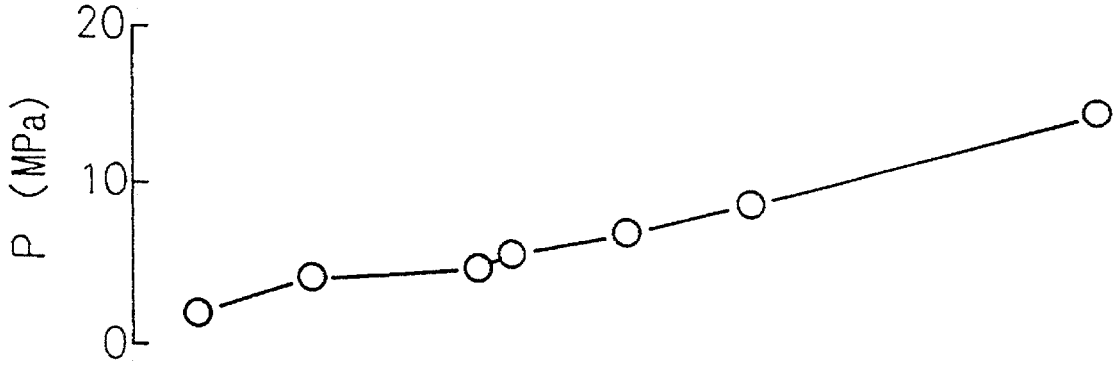
FIG. 5A is a graph of the relationship between the magnitude of the clearance of the throttle passage and the maximum amplitude of the pressure pulsation of the variable pressure chamber for showing the effect of the first embodiment.
Figure 5B:
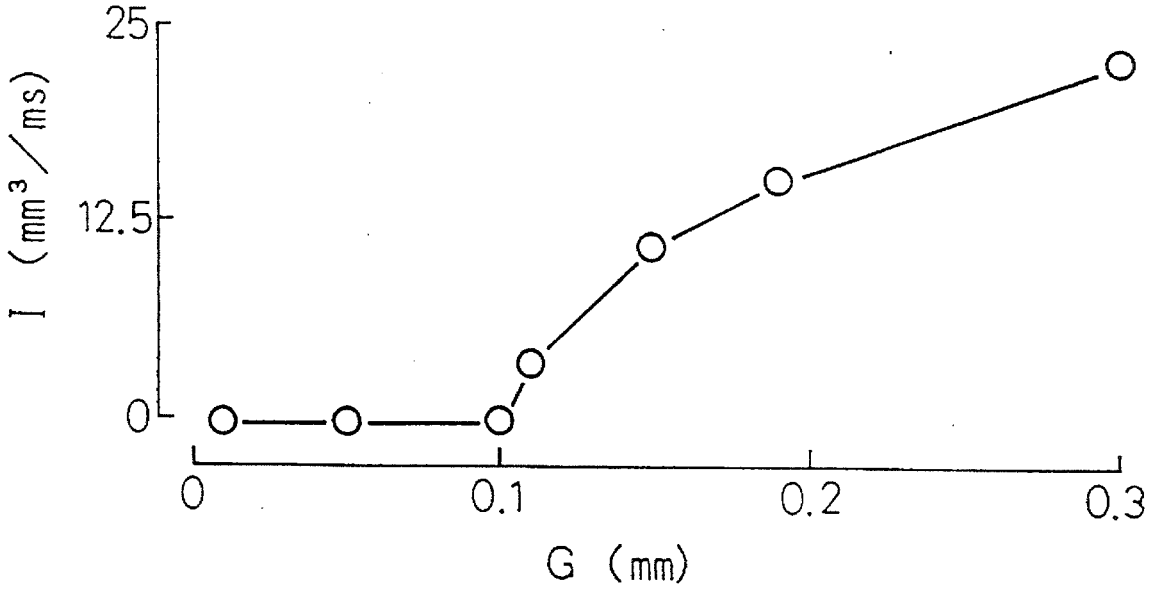
FIG. 5B is a graph of the relationship between the magnitude of the clearance of the throttle passage and the rate of the secondary injection.

The effect of the first embodiment is shown in FIG. 5A and FIG. 5B. The vertical axis P in FIG. 5A shows the maximum amplitude of the pressure pulsation of the variable pressure chamber 31, while the vertical axis I of FIG. 5B shows the rate of secondary injection. In both figures, the horizontal axis G corresponds to the size of the clearance of the throttle passage 21. From these figures, it will be understood that the smaller the clearance of the throttle passage 21, the smaller the pulsation of the variable pressure chamber 31 and the more the transmission of the pressure pulsation is suppressed. If the clearance is set to less than 0.1 mm, the occurrence of secondary injection can be completely prevented.

Figure 6:
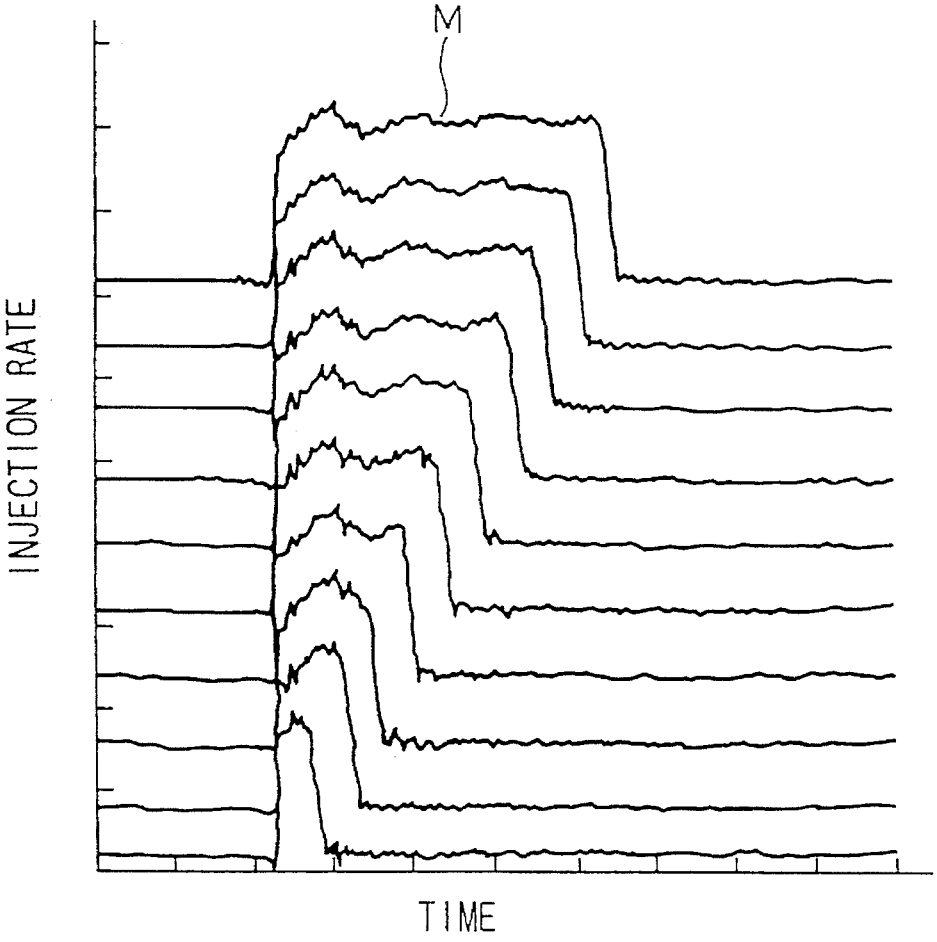
FIG. 6 is a time chart of the injection rate showing the effect of the first embodiment.
Figure 7:
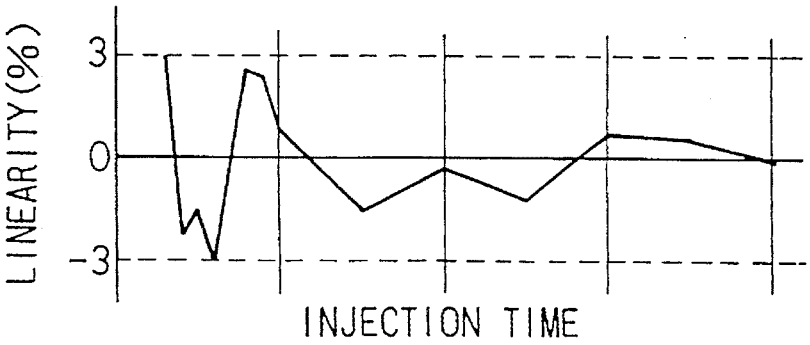
FIG. 7 is a graph of the relationship of the injection time and the linearity of the injection amount.

This effect is further shown in FIG. 6. As will be understood from this figure, even if the fuel injection time is changed, no secondary injection will ever occur after the main injection M. Further, the conduction time of the piezoelectric actuator 1 and the linearity of the amount of fuel injection can be kept from deteriorating drastically in the small volume injection region due to the prevention of the secondary injection, as shown in FIG. 7.

Therefore, it is possible to prevent secondary injection by a simple structure without providing a separate throttle member and by just partially changing the shape of the piston member 2'.

In FIG. 8A showing a second embodiment, the communicating passage 62 communicating the back pressure chamber 61 and variable pressure chamber 31 accommodates a throttle valve 7 with a partially enlarged diameter. The throttle valve 7 forms a cylinder which opens downward and has a throttle hole 71 serving as the throttle portion formed at its top wall. The throttle valve 7 is biased upward by a coil spring 73 disposed between its top wall and the top end of the needle valve 5. At part of the outer circumferential surface and top end of the top wall of the throttle valve 7, there are formed a side passage 72 and a top passage 74 which extend upward, reach the top surface, and communicate with the communicating passage 62.

Figure 8B:
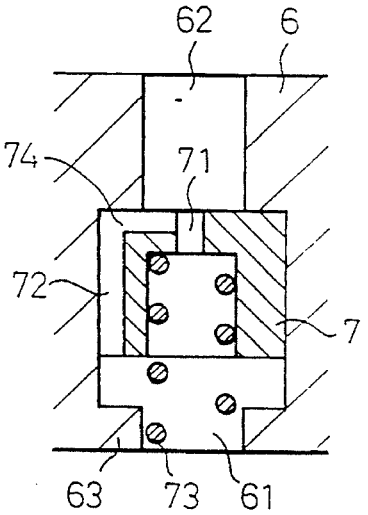
FIG. 8B is a partial enlarged sectional view of important portions of FIG. 8A.

FIG. 8A shows the state a little while after the piston member 2 moves forward and the needle valve 5 is closed. The throttle valve 7 is held at the top end position of its range of movement by the coil spring 73. In this state, if the piston member 2 is made to retract, as shown in FIG. 8B, the side passage 72 and the top passage 74 form a bypass passage connecting to the communicating passage 62 from the back pressure chamber 61 in addition to the throttle hole 71 of the throttle valve 7, so the working fluid quickly flows to the variable pressure chamber 31 and the needle valve 5 retracts so that the fuel injector hole 81 opens.

When the injection is to be stopped, the piston member 2 moves forward and the working fluid flows from the variable pressure chamber 31 to the back pressure chamber 61. Along with this, the throttle valve 7 also descends. Due to this, the internal pressure of the back pressure chamber 61 rises and the needle valve 5 is made to move forward to close the fuel injector 81. During this, a pressure pulsation occurs in the back pressure chamber 61, but at this time the bottom end of the throttle valve 7 abuts against a stopper wall 63 and is inhibited from further descent. Also, the bottom end of the side passage 72 is closed by the stopper wall 63, so the bypass passage 72, 74 is closed. Accordingly, the working fluid just passes through the throttle hole 71 of the throttle valve 7, so the flow resistance increases and the transmission of the pressure pulsation is suppressed. In this way, the pulsation is not amplified by the piston member 2, so the retraction of the needle valve 5 is inhibited and the occurrence of secondary injection is avoided.

Figure 9:
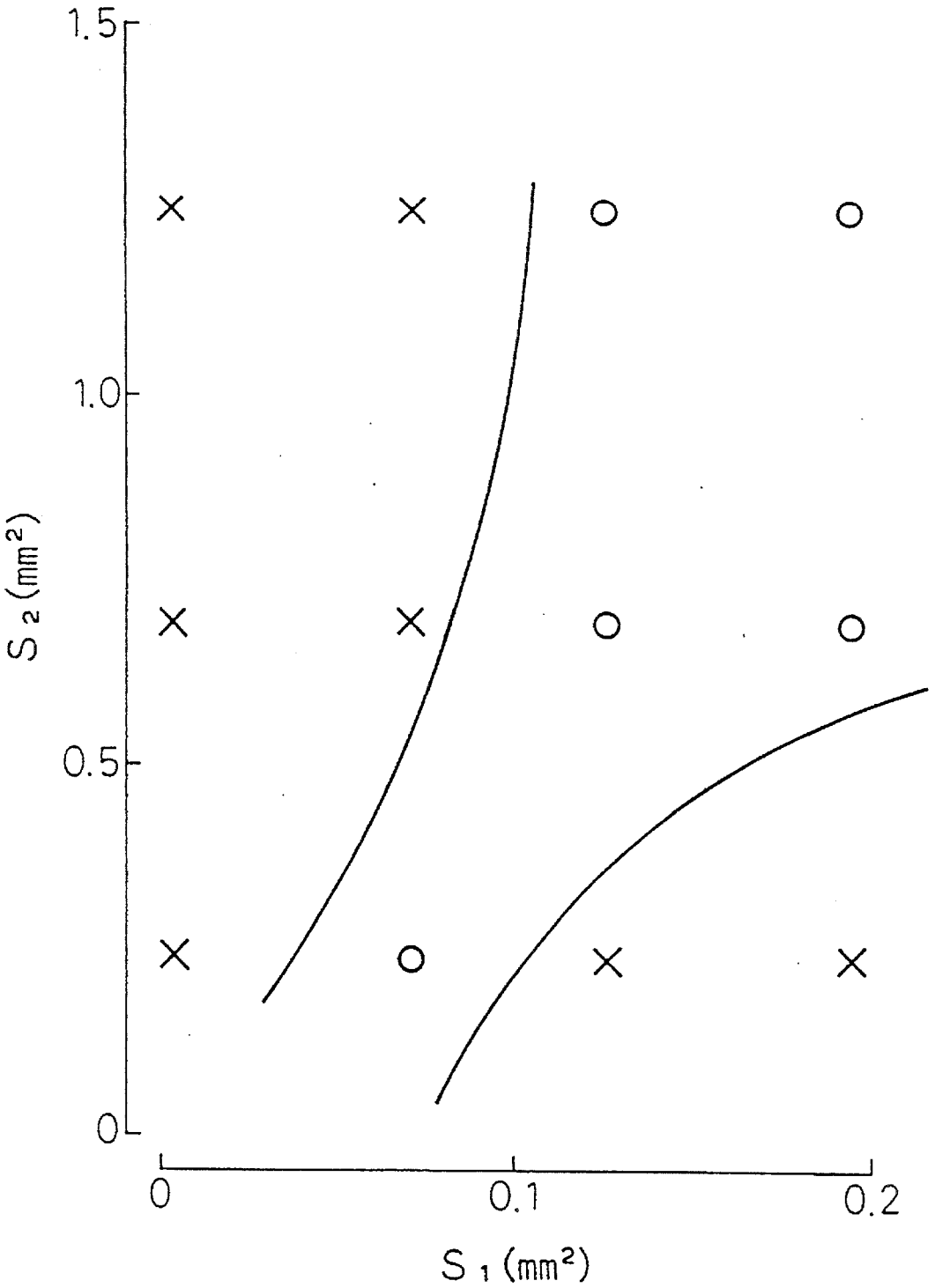
FIG. 9 is a graph of the effect of the second embodiment.

The effects of the second embodiment will be shown in FIG. 9. As will be understood from the figure, if the ratio of the sectional area S, of the throttle hole 71 and the sectional area S2 of the side passage 72 is made a certain relationship (0.09 to 0.4), an excellent result of no secondary injection is obtained (region shown by circle marks in figure). Otherwise, secondary injection occurs, which is not desirable (region shown by X marks in figure). The size of the side passage 72 is limited by the size of the throttle valve 7, so the size should be set within the range satisfying these limitations and the relationship of the figure. Note that even if the throttle hole 71 is made smaller, if the side passage 72 is large, the desired effects cannot be obtained because the working fluid ends up flowing through the side passage 72 when the piston 2 moves forward, whereby throttle valve 7 cannot descend swiftly.

Therefore, by providing a throttle valve 7 with a simple structure in the communicating passage 62, it is possible to effectively prevent the secondary injection and obtain a similar effect as in the above embodiment. Further, various conditions of use can be handled due to the separately provided throttle valve 7.

We claim:

1. A fuel injector for internal combustion engines comprising:

a piezoelectric actuator which extends and contracts by conduction, a piston member which retracts and moves forward along with said piezoelectric actuator, a variable pressure chamber which is filled with a working fluid and made to rise in pressure when said piston member moves forward, a back pressure chamber which communicates with said variable pressure chamber, said working fluid flowing in sealed relation between said variable pressure chamber and said back pressure chamber, a needle valve which opens and closes a fuel injector hole in accordance with a pressure within said back pressure chamber, a throttle valve for throttling flow of said working fluid between said variable pressure chamber and said back pressure chamber, said throttle valve including a throttle hole and a bypass passage, said throttle valve being movable from a first end position when said piston member moves forward, wherein said throttle hole throttles flow of said working fluid from said variable pressure chamber to said back pressure chamber with said bypass passage being closed, causing said needle valve to close said fuel injector hole, to a second end position when said piston member retracts, wherein said bypass passage is open and enables said working fluid to flow from said back pressure chamber through said bypass passage and said throttle hole, so that said needle valve opens said fuel injector hole.

2. A fuel injector according to claim 1, wherein said throttle valve is biased toward said variable pressure chamber by an elastic member.

3. A fuel injector according to claim 2, wherein said elastic member is a coil spring.

4. A fuel injector according to claim 3, wherein said spring extends between said needle valve and said throttle valve.

5. A fuel injector according to claim 1, wherein the bypass passage includes a side passage and a top passage.

6. A fuel injector according to claim 5, wherein, in said first end position, said side passage is closed by a stopper wall against which the throttle valve abuts.

* * * * *